US006063331A

United States Patent [19]

Iszczukiewicz

[11] Patent Number: 6,063,331

[45] Date of Patent: May 16, 2000

[54] ANNEALING FURNACES

[75] Inventor: Ludwik Iszczukiewicz, Parma, Ohio

[73] Assignee: Rad-Con Incorporated, Cleveland, Ohio

[21] Appl. No.: 09/067,699

[22] Filed: Apr. 28, 1998

[51] Int. Cl.[7] ..... C21D 1/00

[52] U.S. Cl. ..... 266/264; 266/262

[58] Field of Search ..... 266/252, 262, 266/263, 264

[56] References Cited

U.S. PATENT DOCUMENTS

| | | | |
|---|---|---|---|
| 3,097,837 | 7/1963 | Jacob | 266/264 |
| 3,563,522 | 2/1971 | Blackman . | |
| 3,581,810 | 6/1971 | Blackman . | |
| 3,593,971 | 7/1971 | Blackman . | |
| 3,628,778 | 12/1971 | Kennedy | 266/263 |
| 3,633,891 | 1/1972 | Heran . | |
| 4,038,022 | 7/1977 | Blackman . | |
| 4,165,868 | 8/1979 | Southern | 266/264 |
| 4,278,242 | 7/1981 | Freund et al. | 266/263 |
| 4,813,654 | 3/1989 | Singler . | |
| 4,867,575 | 9/1989 | Wood . | |
| 4,964,798 | 10/1990 | Blackman . | |
| 5,388,809 | 2/1995 | Hemsath | 266/264 |

*Primary Examiner*—Scott Kastler
*Attorney, Agent, or Firm*—Willaim N. Hogg

[57] ABSTRACT

A bell type annealing furnace structure that includes a base which has a base plate member and an annular channel therearound. A plurality of circumferentially spaced enclosure members are provided, each having a coil support section with support legs depending therefrom supporting the enclosure member on the base plate member and defining a space between the base plate member and the coil support section. The enclosure members are configured to form a central annular opening, and joints interconnect each of the enclosure members. Each joint includes a web member extending between the adjacent enclosure members and is curved toward the base plate member. Reinforcing segments are disposed in the spaces between and engaging both the base plate member and the coil support section. A cap member is disposed in the annular opening defined by the enclosure members, and includes an upper section and an annular leg depending therefrom engaging the base plate member. The cap member is configured to prevent bowing of the upper section away from the base plate member upon heating. An inflatable seal is mounted in said channel surrounding the base. A bell inner cover has a radially extending plate around the lower portion thereof, and when the bell inner cover is disposed over the base the radially extending plate in contact with the annular inflatable seal, and the inflatable seal is inflated. The bell inner cover has an annular channel thereon. A furnace member is placed over the bell inner cover, with the furnace member having a seal extending circumferentially therearound and sealing in the annular channel in the bell inner cover, with the seal on the furnace member having, ceramic fibers enclosed in wire mesh.

17 Claims, 9 Drawing Sheets

ANNEALING FURNACES

BACKGROUND OF THE INVENTION

1. Field of the Invention

This invention relates generally to annealing furnaces, and more particularly to bell type annealing furnaces for annealing coils of material in a controlled atmosphere.

2. Background Information

Bell type annealing furnaces are well known in the art and have been used for many years to anneal coils to materials such as coils of steel strip or wire or rod. In essence, the annealing furnace includes a base which provides a support for the coils. A bell cover is provided which is placed over the coils and seals against the base to provide a scaled interior for circulation of inert gas or other controlled atmospheres which may be required for annealing or other metallurgical processes. A fan is mounted on the base for circulating the gas within the bell cover. An outer furnace is provided which is heated either by electricity or gas combustion and is scaled over the bell cover sometimes sealing on the bell cover and sometimes sealing on the base.

There are many considerations that go into the design and construction of these bell furnace installations. Among these considerations is included: the necessity to seal the inner bell cover against gas leakage as well as the need to seal the outer cover against air and gas, leakage and the need to accommodate thermal expansions at the elevated temperatures and especially to accommodate the thermal expansion wherein there are significant temperature gradients between different locations of the furnace structure. This must be done in a manner which is strong enough to support the coils being treated and promote maximum air flow and circulation to prevent any hot spots or heat build-ups at elevated temperatures. Moreover, the use of the same parts for different size furnaces is an important aspect of the economical construction of different size furnaces.

SUMMARY OF THE INVENTION

A bell type annealing furnace structure is provided. The structure includes a base which has a base plate member and an annular channel therearound. A plurality of circumferentially spaced enclosure members are provided, each having a coil support section with support legs depending therefrom supporting said enclosure member on the base plate member and defining a space between said base plate member and said coil support section.

The enclosure members are configured to form a central annular opening. Joints are provided interconnecting each of said enclosure members, and each joint includes a web member extending between said adjacent enclosure members and curved toward the base plate member. Reinforcing segments are disposed in the spaces between and engaging both said base plate member and the coil support section.

A cap member is disposed in the annular opening defined by the enclosure members and includes an upper section and an annular leg depending therefrom engaging the base plate member. The cap member is configured to prevent bowing of the upper section away from the base plate member upon heating.

An inflatable seal is mounted in said channel surrounding said base. A bell inner cover is provided having a radially extending plate around the lower portion thereof, and the bell inner cover is disposed over the base with the radially extending plate in contact with the annular inflatable seal and with the inflatable seal being inflated. The bell inner cover has an annular channel thereon. A furnace member is placed over the bell inner cover, with the furnace member having a seal extending circumferentially therearound and sealing in said annular channel in said bell inner cover, with the seal on said furnace member having ceramic fibers enclosed in wire mesh.

DESCRIPTION OF THE PREFERRED EMBODIMENT(S)

Figure 1:
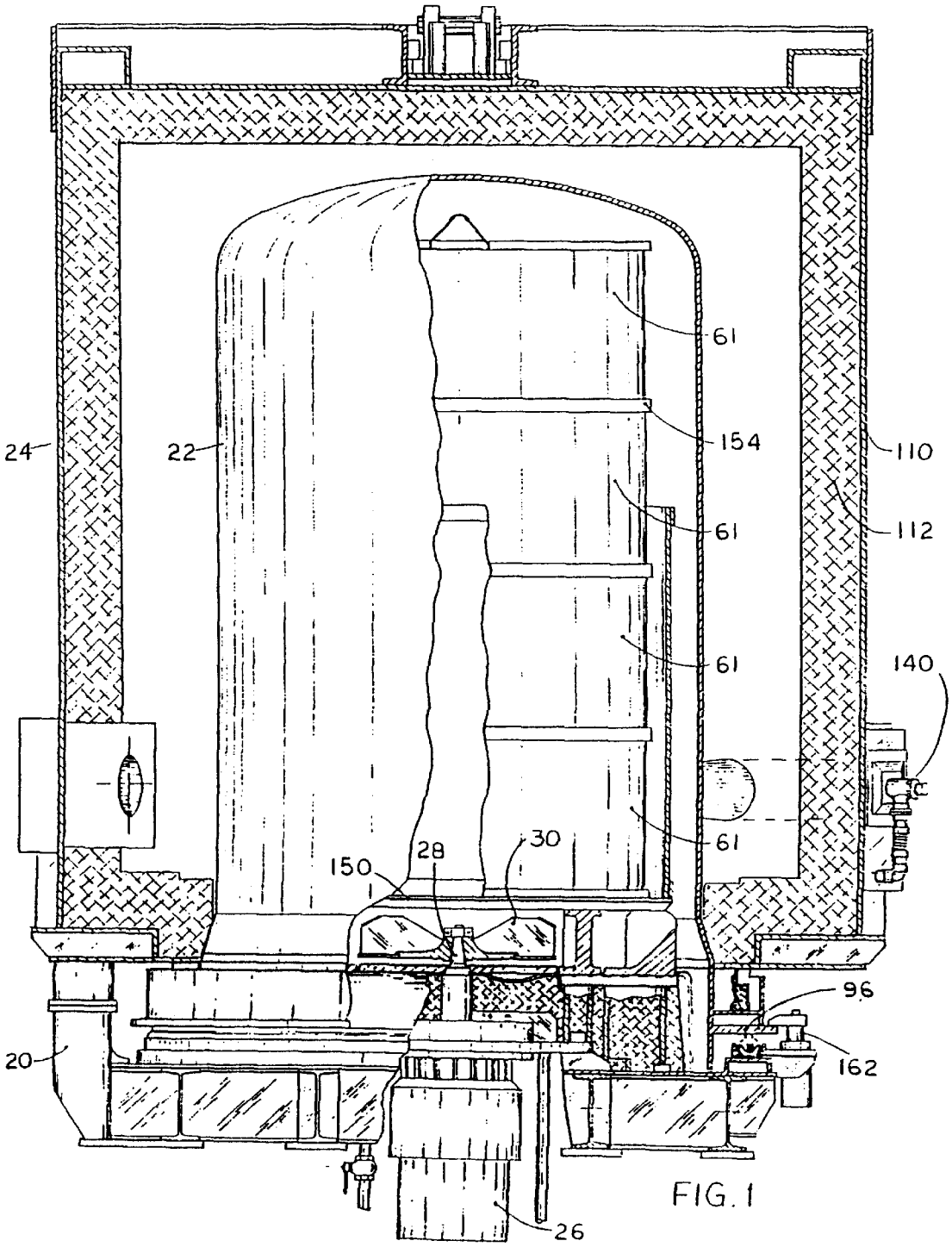
FIG. 1 is a side elevational view, partially in section, with parts broken away for clarity, depicting the present invention.

Referring now to the drawings, and for the present to FIGS. 1–4 a furnace installation incorporating the embodiments of the present invention is shown. The furnace installation includes a base designated generally as 20, an inner cover designated generally as 22 and a furnace member designated generally as 24. A fan motor 26 is secured to the base 20 having a fan shaft 28 extending therefrom and terminating at a fan 30 which is adapted to circulate gases within the inner cover 22 when the inner cover is in place and sealed. The circulation of gas within the inner cover is well known in the art using fans and fan motors.

Figure 7:
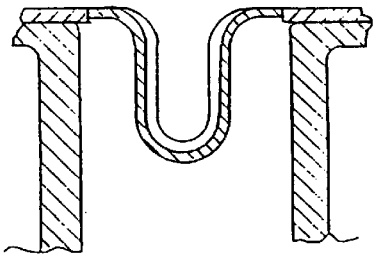
FIG. 7 is a sectional view taken through a joint section of the embodiment of FIG. 5 at the location I—I designated in FIG. 5.

As can be seen the base 20 includes a lower base plate 36 mounted on "I" beam 37 and on which is supported a segmented steel enclosure member 38. The I beams 37 have holes 39 therein to provide for heat circulation. Enclosure member 38 includes a plurality of generally pie or wedge shaped sections 40, each having coil support surfaces 41, these sections being joined by a joint 42. As can best be seen in FIGS. 3, 5, and 7 joint 42 includes a longitudinally extending folded member 44 and an end section 46 welded to the folded member 44. The end section 46 has a slot 48 therein. The sections 40 each have depending tapered support legs 50 (FIGS. 2 and 4) welded to base plate 36. Thus each of the sections 40 defines a space 51 between the section of the cover 40 and the base plate 36. The members 44 are formed of a thinner gauge steel than the sections 40 and thus are free to flex to accommodate thermal expansion especially differential thermal expansion during heating as will be described presently.

Figure 6:
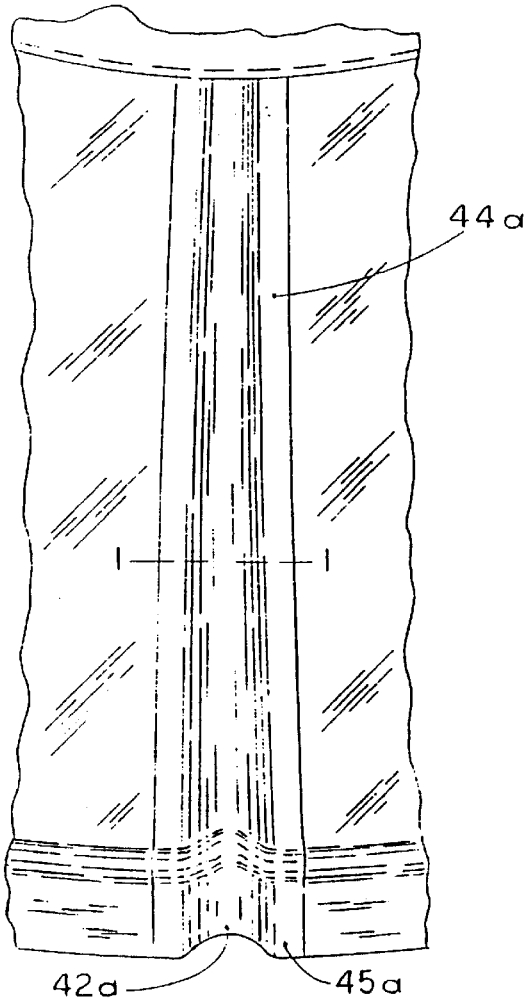
FIG. 6 shows another embodiment of the joint between the wedge-shaped sections of the base.
Figure 5:
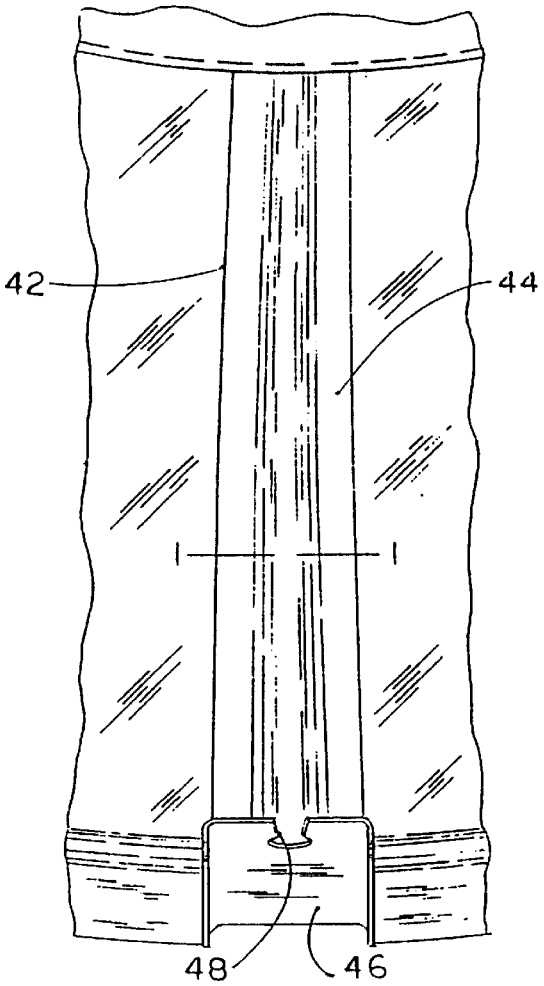
FIG. 5 is a detailed plan view of the wedge-shaped sections of the base.

FIG. 6 shows another embodiment of a joint 42*a* wherein a longitudinally extending folded member 44*a* has its end portion 45*a* folded over rather than a separate end plate welded thereto as in FIG. 5. This is somewhat more difficult to fabricate than the joint in FIG. 5.

Figure 3:
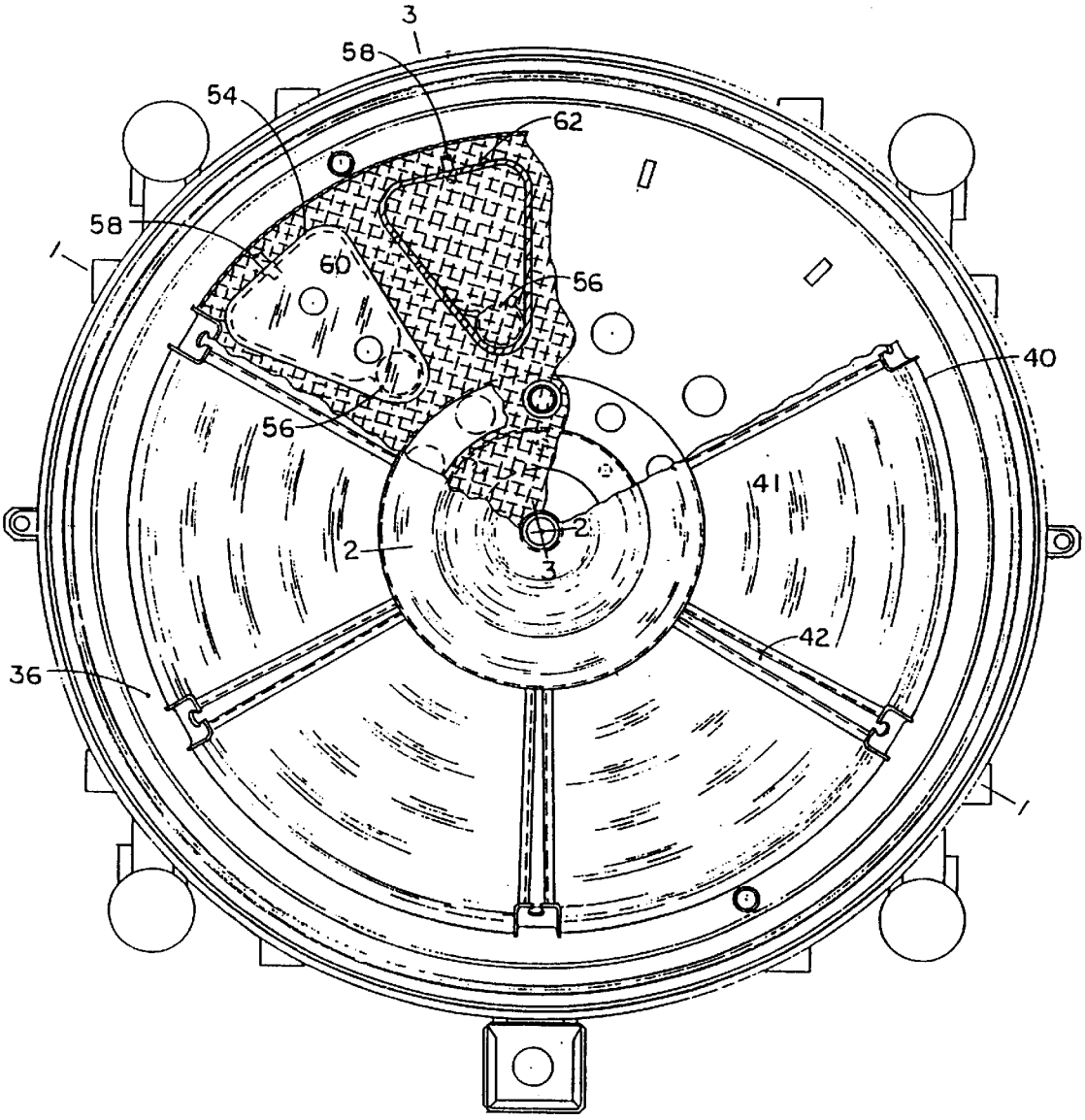
FIG. 3 is a plan view, partially in section, with parts broken away for clarity, of the base section incorporating the present invention.
Figure 11:
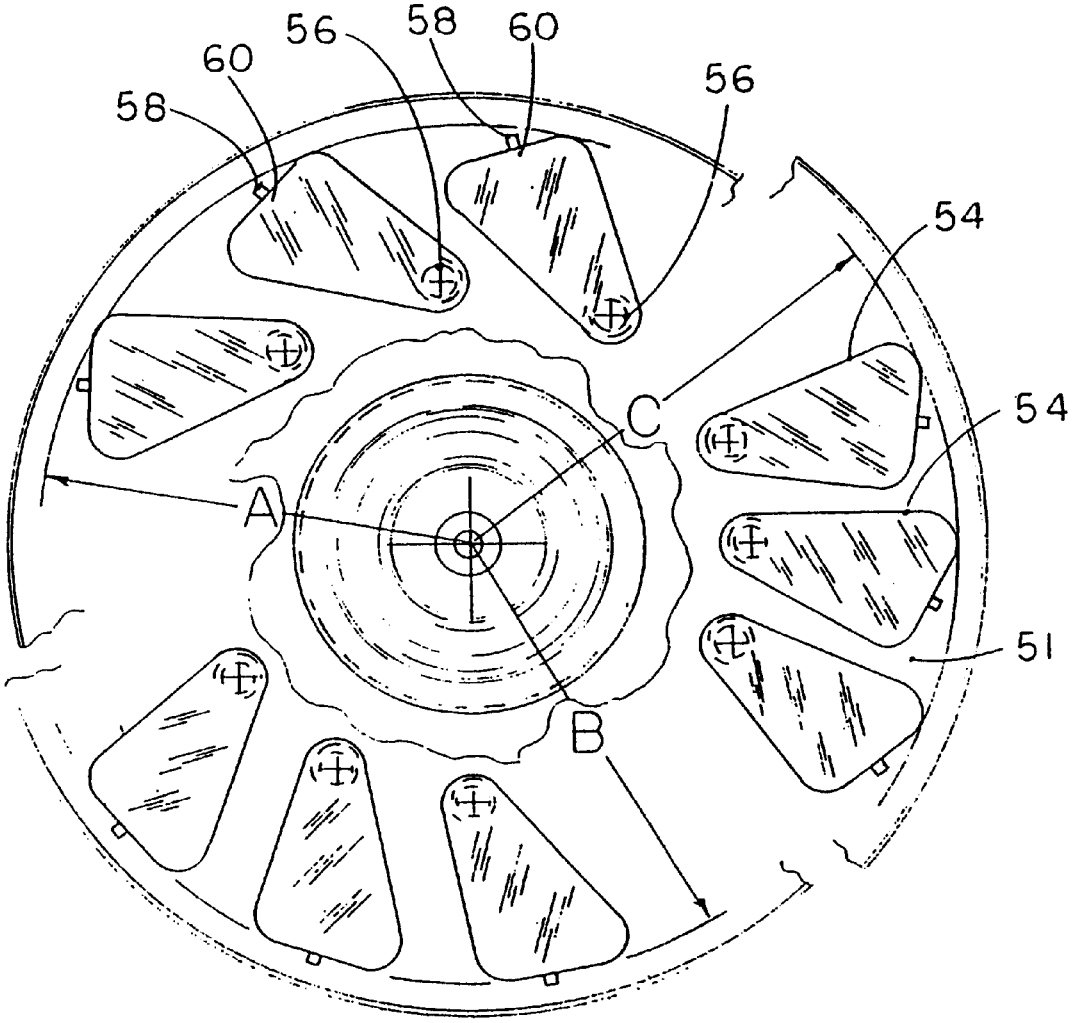
FIG. 11 is a plan view, partially in section, with parts broken away for clarity, showing reinforcing segments of the base member.

As best seen in FIGS. 3 and 11, disposed within each of the spaces is a triangular shaped reinforcing segment 54. The reinforcing segment 54 is pivotally mounted on a pivot post 56 extending upwardly from the lower base member 36 and is keyed into position by keys 58 which are welded to the lower base member 36 and project into slots 60 formed in one leg of the reinforcing segments 54. The reinforcing segments extend up from the lower base member 36 into contact with the top of the member 40 to provide additional support for coils 61 stacked thereon.

Preferably the triangular reinforcing segments 54 are in the form of scalene triangles and by pivoting the segments 54 about the pivot post 56 their radial extension can be changed thereby allowing them to be used for different size lower base members 36 thereby defining different size plates. These thus define different size bases for the furnace using the same reinforcing segments 54. This is shown diagrammatically in FIG. 11, wherein different ones of the segments 54 are shown pivoted to subtend outer circles which vary in diameter.

Insulating material 62 is also provided within the spaces 51 and 52. Preferably the insulating material 62 is a ceramic fiber which is well known in the art.

Figure 2:
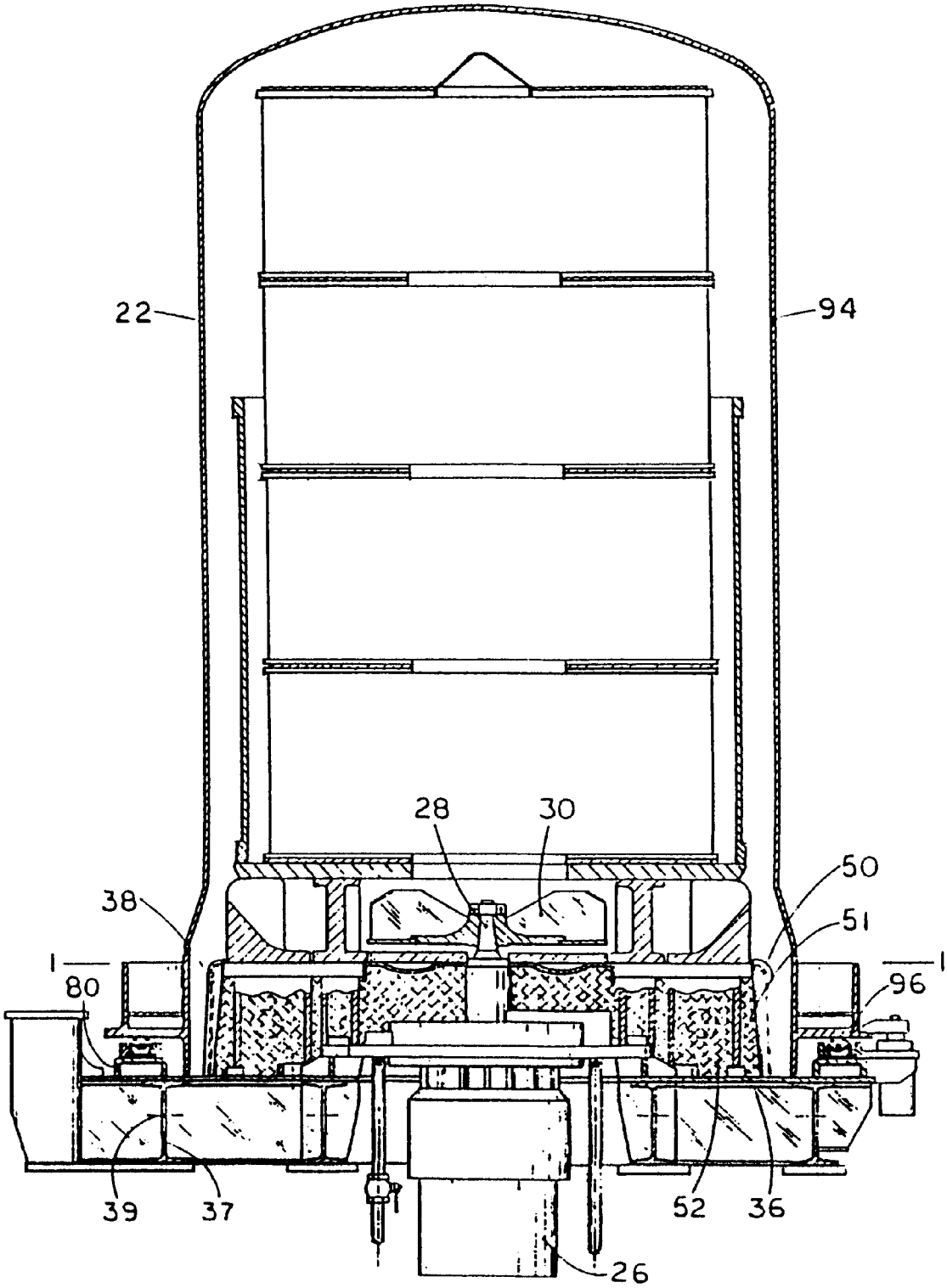
FIG. 2 is a longitudinal sectional view of a portion of the invention as shown in FIG. 1, with parts broken away for clarity.
Figure 4:
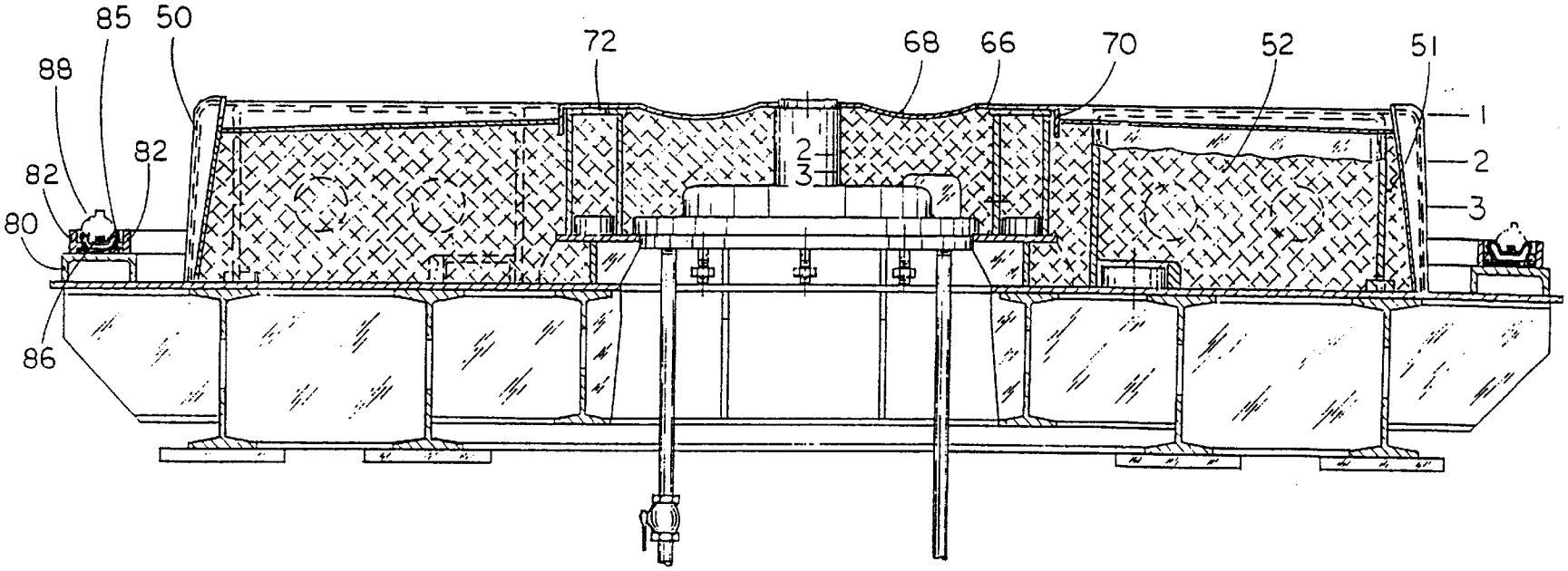
FIG. 4 is a longitudinal sectional view of the base section incorporating the present invention.

As can best be seen in FIGS. 2 and 4, a central cap member 66 is also provided which overlies the fan motor 26 and is welded to the internal ends of the sections 40 of the enclosure member 38. The central cap 66 has a radial disc 68 with a flange 70 depending therefrom and mounted on support assembly 72 which in turn is mounted on the lower base member 36. The radial disc 68 is generally disc shaped and has a depression therein extending downwardly toward the base member 36. This will control the direction flexure of the disc 68 upon heating so that the bowing or flexure will be in a downward direction which is acceptable rather than in an upward direction toward the fan which could interfere with the fan.

Referring again to FIGS. 2 and 9, the base section 20 also has a tubular support section 80 having a pair of radially spaced annular rims 82 extending upwardly therefrom and defining a space 83 there between. Each of the annular rims 82 has a rib 84 extending into the space 83. An inflatable seal 85 is provided which has a lower section 86 mounted on the tubular section 80 and a top projection 88. The inflatable seal 85 is hollow and can be inflated by the use of gas pressure such as by use of air or preferably nitrogen (through a valve assembly not shown) to inflate it to the inflated position as shown in broken lines in FIGS. 4 and 9. The ribs 84 retain the seal 85 in the space 83.

Figure 8:
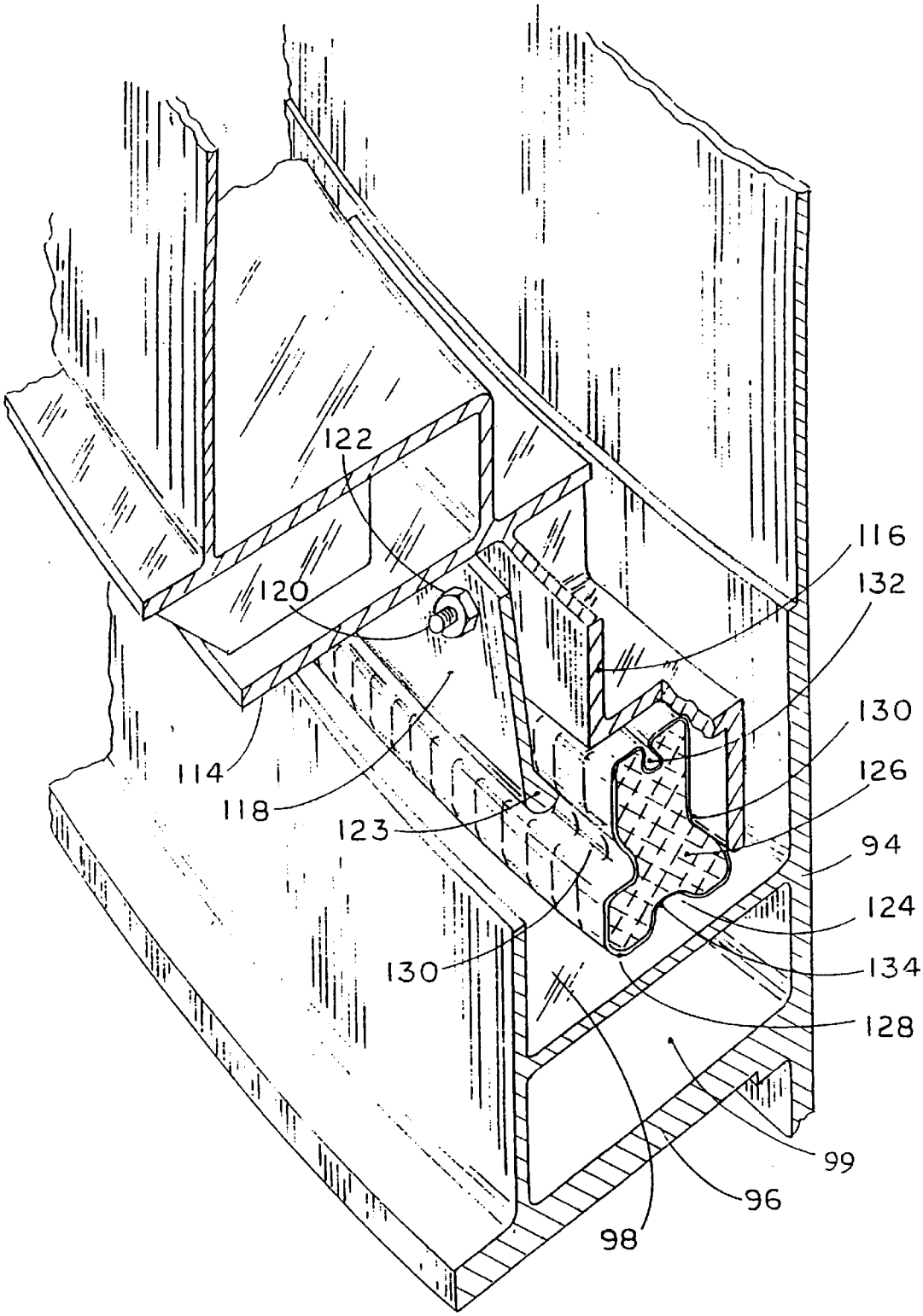
FIG. 8 is a perspective view, partially in section, showing construction of the insulating seal and associated features.
Figure 9:
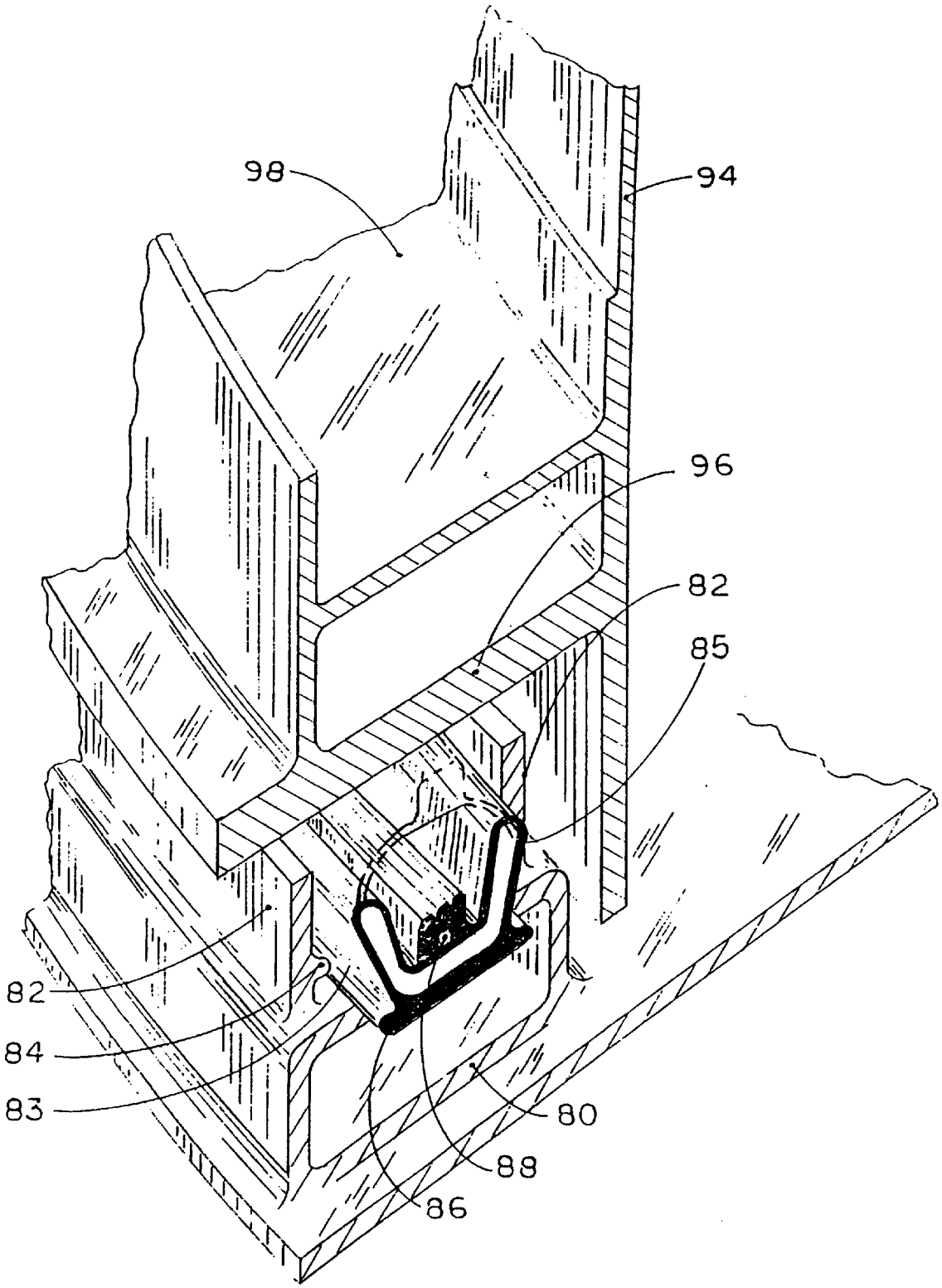
FIG. 9 is a perspective view, partially in section, showing an inflatable seal on top of the base.

As best seen in FIGS. 2, 8, and 9 the inner cover 22 includes a bell shaped member 94 having a laterally extending flange 96 projecting therefrom. The lateral flange 96 is positioned to co-act with and seal the inner cover 22 when the inner cover 22 is in place as shown in FIGS. 1, 2 and 9 by sealing against the inflated seal 85. This will provide an essentially gas tight structure between the inner cover and the space around the furnace when the furnace member is in place. The inner cover 22 also includes an annular well 98 formed thereon which serves as a water channel during cooling as is well known in the art and also serves to co-act against an insulating seal for sealing the furnace member thereon as will be described presently. The flange 96 and well 98 define between them an enclosed water channel 99, which allows water to be circulated therein to coat the seals as will be described presently.

As can best be seen in FIGS. 1 and 8, the furnace member 24 includes an outer shell 110 which has insulating material 112 internally thereof which insulation is well known in the art. A bottom flange 114 extends radially outwardly from the outer shell 110 and has welded thereto a depending L shape member 116. An annular retaining ring 118 is provided which is secured to the L shaped member 116 by the bolt 120 and nut 122. The retaining ring 118 has a enlarged end section or protrusion 123 for a purpose which will be explained presently. An insulating seal 124 is provided which is formed of a core of ceramic fiber 126 with a stainless steel mesh 128 surrounding it. The insulating seal 124 has a central indentations 130, a top indentation 132 and bottom indentation 134. Protrusion 123 projects into one of the central indentations and serves to secure the insulating seal 124 to the depending L shaped member 116 thereby providing a seal that extends around the furnace member 24. The indentations 132 and 134 are provided to direct the expansion of the seal both during clamping action of the nut and bolt 120, 122 against retaining ring 118 and also the thermal expansion upon heating.

The furnace also is provided in a well known manner with burners 140 which can be connected to gas connections and may have recooperators (not shown) attached thereto which, in a well known manner, reheat the air for combustion.

In operation and as can best be seen in FIGS. 1 and 2, a coil support member 150 is placed on the base 20 and coils 61 are stacked on the support member 150. Typically the coils 61 will be separated by coil plates or supports 154. In this position the inner cover 22 is placed over the base 20 covering the coils 61 and the inflatable seal 85 is inflated so as to seal against the annular flange 96 on the inner cover 22. The bell member 94 of the inner cover 22 rests on the lower base member 36 of the base 20. The Hydraulic or pneumatic pressure is applied to cylinders 162 mounted on base 20 to hold inner cover member 96 downward as shown in FIG. 1. When the seal 85 is inflated, the interior of the bell shaped cover is essentially sealed from ambient around the outer periphery thereof.

Following the placement of the inner cover 22 over the coils 61, the furnace member 24 is positioned over the inner cover 22 with the insulating seal 124 resting on the bottom of the well 98 on the inner cover 22 as shown in FIGS. 1 and 8.

In this configuration the furnace is ready to be heated to the temperature required to anneal the coils. In many annealing operations, the coils must be protected from oxidation which is accomplished by recirculating inert gas such as hydrogen or nitrogen inside the cover 22 by means of the fan 30. (For annealing purposes hydrogen and nitrogen are considered as inert gases.) This will cause an increase in temperature of the various parts of the furnace's structure. Particularly affected in this increase in temperature is the central cap 66 and the enclosure member 38. The heating of these members causes an expansion of the steel used to form them. As indicated above, the cap member is provided with the disc 68 dished downwardly; thus the expansion will drive this disc downwardly rather than upwardly so as to prevent its interfering with the fan which circulates the inert gas within the inner cover. Also the joints 42 which are formed of a thinner metal than the sections 40 allow for circumferential expansion of each of the sections 42 of the cover member to thereby prevent cracking. It is especially important that the sections be protected against expansion since there can be a substantial gradient of temperature from the top of the sections 40 to the bottom of the support legs 50 with this requiring significant expansion capabilities at the top thereof. The structure of this invention allows the support legs 50 to be welded to the lower base member 36 and still provide for the necessary expansion because it is at a relatively low temperature during operation at this location, and yet allow for the expansion of the sections 40 of the cover member to take place at the top thereof where they are heated to a much higher temperature during operation. Moreover, water is circulated in channel 99 and tubular section 80 during heating of the furnace to coat seals 124 and 85.

Figure 10:
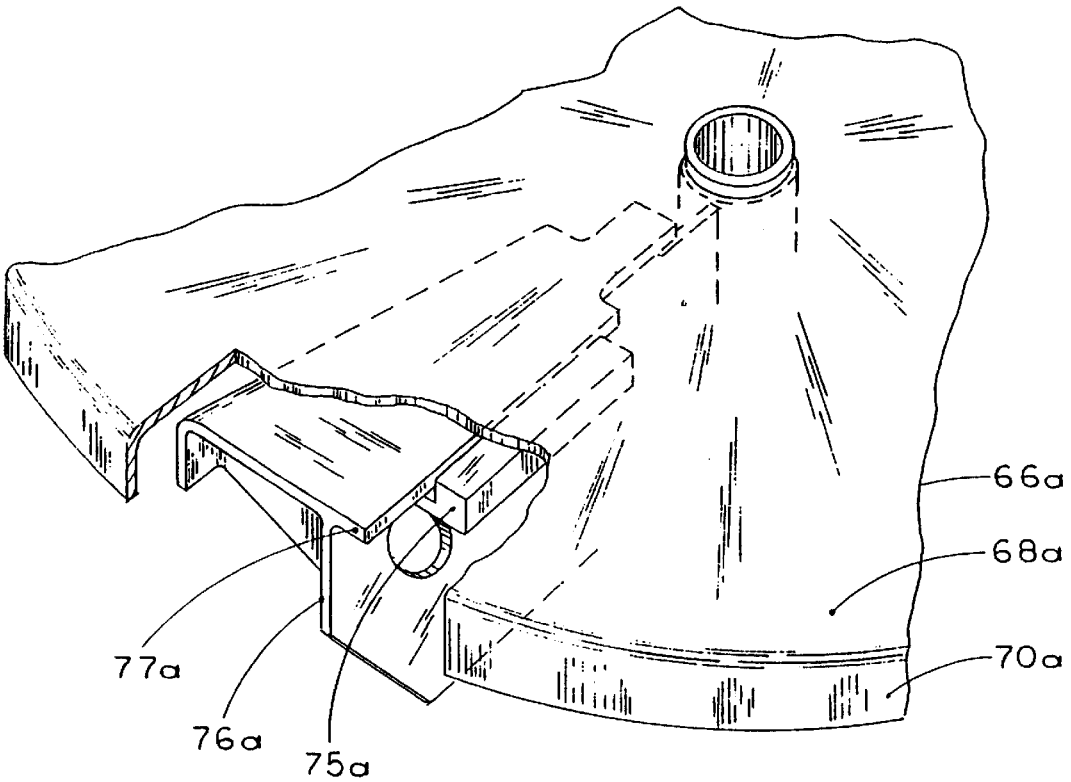
FIG. 10 is a perspective view, partially in section, with parts broken away for clarity, of a portion of the central cap on the base.

Referring now to FIG. 10, another embodiment of the central cap 66*a* is shown. In this embodiment disc 68*a* is provided which has a flange 70*a* extending downwardly therefrom. However, in this embodiment, several L shaped section of material one of which is shown at 75*a* are welded to the underside of the disc 66*a* and several L shaped member one of which is shown at 76*a* are welded to and extend upwardly from the lower base member 36. Laterally extending sections 77*a* engages the members 75*a* and thus during heating prevents the disc 68*a* from warping either upwardly or downwardly, thus remaining essentially flat. In this case the cap 66*a* is formed by first welding the members 76*a* to the base member 36. The L shaped sections 75*a* are welded to the under side of disc 68*a*. The disc 68*a* is assembled to the member 77*a* by bringing the disc 68*a* with the flange 70*a* into contact with the sections 75*a*. The disc 66*a* is then rotated to engage the members 77*a* and 76*a*. Thus, this configuration eliminates the need to have a depression in the disc 68*a* and it can remain flat with this configuration preventing the flexure either up or down of the disc.

While the present invention has been illustrated by the description of embodiments thereof, and while the embodiments have been described in considerable detail, it is not the intention of application to restrict or in any way limit the scope of the appended claims to such detail. Additional advantages and modifications will readily appear to those skilled in the art. For example, but not by way of limitation, certain procedures may be called or implemented in different sequences and certain procedures may be subroutined into one or more subroutines. Therefore, the invention, in its broader aspects, is not limited to the specific details, the representative apparatus, and illustrative examples shown and described. Accordingly, departures may be made from such details without departing from the spirit or scope of the applicant's general inventive concept.

What is claimed is:

1. A base for a bell annealing furnace structure, which includes a base plate member; comprising:

a plurality of circumferentially spaced enclosure members each having a coil support section and support legs depending therefrom supporting said enclosure member on said base plate member, a joint interconnecting each of said enclosure members, each of said joints including a web member extending between adjacent enclosure members and curved toward said base plate member to thereby provided for thermal expansion of said enclosure member upon heating.

2. The invention as defined in claim 1 wherein said web member is thinner than said coil support section.

3. The invention as defined in claim 1 wherein an end plate is connected to each of said web members and depends therefrom toward said base member, each said web plate having a slot therein extending downwardly from said web member.

4. A base for a bell annealing furnace structure which includes a base plate member comprising:

at least one enclosure member each having a coil support section and support legs depending therefrom supporting said at least one enclosure member on said base plate member and defining a space between said base plate member and said coil support section, and at least one reinforcing segment in said space interposed between and engaging both said base plate member and said enclosure member.

5. The invention as defined in claim 4 where therein are a plurality of enclosure members and a plurality of reinforcing segments.

6. The invention as defined in claim 5 where in each of said reinforcing segments is pivotally mounted on a pivot post carried by said base plate member and keyed to said base plate in member.

7. The invention as defined in claim 6 wherein said each of said reinforcing segments is generally triangular shaped in plan view.

8. The invention as defined in claim 7 wherein said general triangular shape is a scalene triangle.

9. A base for a bell annealing furnace structure which includes a base plate member comprising:

at least one coil support member, each having a coil support section and support legs depending therefrom supporting said coil support member on said base plate member, an annular opening centrally in said at least one coil support member, a cap member disposed in said annular opening, said cap member including an upper section and an annular leg depending therefrom engaging the base member, said cap member being configured to prevent upward bowing of the upper section away from said base member upon heating.

10. The invention as defined in claim 9 wherein said configuration to prevent bowing away from said base member includes said upper section being dished toward said base member.

11. The invention as defined in claim 9 wherein said configuration to prevent bowing of the cap section away from said base member includes interlocking member carried by said upper section and mounted on said base plate member arranged to prevent dishing of said upper section away from said base member.

12. A bell annealing furnace structure comprising, a base, said base having an annular channeled therearound, an inflatable seal mounted in said channel, a bell inner cover, said bell inner cover having a radially extending plate around the lower portion thereof, said bell inner cover being dispersed over said base with said plate in contact with said annular inflatable seal; and said seal being inflated.

13. A bell furnace structure comprising:

a base, a bell inner cover disposed over said base, said bell inner cover having an annular channel thereon, a furnace member dispersed over said bell inner cover, said furnace member having a seal extending circumferentially therearound and sealing in said channel in said bell inner cover, said seal on said furnace member including ceramic fibers enclosed in wire mesh.

14. The invention as defined in claim 13 wherein said seal as on said furnace member is secured to said furnace member by an annular band.

15. The invention as defined in claim 14 wherein said annular band includes a protrusion engaging said seal.

16. The invention as defined in claim 14 wherein said seal has at least one indentation therearound.

17. A bell annealing furnace structure comprising:

a base which includes a base plate member and an annular channel therearound, a plurality of circumferentially spaced coil support members each having a coil support section with support legs depending therefrom supporting said coil support member on said base plate member and defining a space between said base plate member and said coil support section, said coil support members being configured to form a central annular opening, joints interconnecting each of said coil support members, each of said joints including a web member extending between said adjacent coil support members and curved toward said base plate member, reinforcing segments disposed in said spaces between and engaging both said base plate member and said enclosure members, a cap member disposed in said annular opening defined by said enclosure members including an upper section and an annular leg depending therefrom engaging said base plate member, said cap member being configured to prevent bowing of the upper section away from said base member upon heating, an inflatable seal mounted in said channel surrounding said base, a bell inner cover having a radially extending plate around the lower portion thereof, said bell inner cover being disposed over said base with said radially extending plate in contact with said annular inflatable seal and with said inflatable seal being inflated, said bell inner cover having an annular channel thereon, a furnace member disposed over said bell inner cover, said furnace member having a seal extending circumferentially therearound and sealing in said annular channel in said bell inner cover, said seal on said furnace member enclosed ceramic fibers included in wire mesh.

* * * * *